United States Patent [19]

Sato et al.

[11] Patent Number: 4,498,950

[45] Date of Patent: Feb. 12, 1985

[54] PORTABLE LABEL APPLYING MACHINE

[75] Inventors: Yo Sato, Tokyo; Tadao Kashiwaba, Kitagami, both of Japan

[73] Assignee: Kabushiki Kaisha Sato, Japan

[21] Appl. No.: 587,274

[22] Filed: Mar. 7, 1984

Related U.S. Application Data

[60] Division of Ser. No. 452,707, Dec. 23, 1982, Pat. No. 4,436,573, which is a continuation-in-part of Ser. No. 368,732, Apr. 15, 1982, Pat. No. 4,440,592.

[30] Foreign Application Priority Data

| | | | |
|---|---|---|---|
| Apr. 30, 1981 | [JP] | Japan | 56-66223 |
| Dec. 28, 1981 | [JP] | Japan | 56-210021 |
| Jan. 20, 1982 | [JP] | Japan | 57-4943[U] |

[51] Int. Cl.[3] ..... B65C 11/00

[52] U.S. Cl. ..... 156/577; 101/288, 156/384, 579, 156/584, DIG. 33, DIG. 48

[58] Field of Search ..... 156/384, 541, 577, 579, 156/584, DIG. 33, DIG. 47, DIG. 48; 101/288

[56] References Cited

U.S. PATENT DOCUMENTS

| | | | |
|---|---|---|---|
| 3,801,408 | 4/1974 | Kuring et al. | 156/584 |
| 3,944,455 | 3/1976 | French | 156/584 |
| 4,350,554 | 9/1982 | Pabodie | 156/384 |
| 4,359,939 | 11/1982 | Sato | 101/288 |
| 4,406,727 | 9/1983 | Fujita | 156/384 |
| 4,439,257 | 3/1984 | Sato et al. | 156/577 |

FOREIGN PATENT DOCUMENTS

| | | |
|---|---|---|
| 5811639 | 1/1983 | Japan . |
| 5820632 | 2/1983 | Japan . |
| 5820633 | 2/1983 | Japan . |
| 5824489 | 2/1983 | Japan . |

*Primary Examiner*—Michael Wityshyn

*Attorney, Agent, or Firm*—Ostrolenk, Faber, Gerb & Soffen

[57] ABSTRACT

A portable label applying machine for applying labels to articles, especially accurate labels previously printed with distinct and accurate indications such as bar codes. The label applying machine carries a label cassette. The label cassette is removable and replaceable as a unit in the label applying machine. The label cassette is a complete unit with a supporting section for supporting a rolled label strip, a peeling section to peel labels and a guide section along one side to guide a backing paper of the label strip. The label applying machine detachably holds the label cassette and is provided with a self-contained feeding mechanism to shift the backing paper along the guide section and an applying section for applying peeled labels to articles. A plurality of cassettes with pre-printed bar code labels may be used interchangeably with a single label applying machine.

31 Claims, 16 Drawing Figures

PORTABLE LABEL APPLYING MACHINE

RELATED APPLICATIONS

This application is a division of Ser. No. 452,707, filed Dec. 23, 1982 and now U.S. Pat. No. 4,436,573; which is a continuation-in-part of Ser. No. 368,732, filed Apr. 15, 1982 and now U.S. Pat. No. 4,440,592.

BACKGROUND OF THE INVENTION

1. Field of the Invention

This invention relates to a portable label applying machine. More particularly, the invention relates to a label applying machine which is used for peeling removably positioned labels from a web of backing paper on which the labels are positioned one after the other in series and applying the peeled labels to articles such as commodities.

2. Description of the Prior Art

Portable label applying machines of this type, which are commonly used in retail shops, supermarkets and the like, are provided with various label printing and applying mechanisms. The label printing and applying machine is generally composed of a supporting device, a printing head, a feeding device and a peeling device. The supporting device supports a rolled label strip in which a plurality of unprinted labels are carried in sequential or series end-to-end relationship on a web of backing paper. The printing head prints the necessary information on the labels. The feeding device advances the label strip and the peeling device peels printed labels one by one from the web of backing paper and delivers the labels outside the machine body. In the portable label printing and applying machine, the printing, feeding and peeling operations are done manually and the peeled labels are attached to articles by pressing them onto said articles.

This portable label printing and applying machine is used for applying printed labels to commodities, usually at a sales counter or an article supporting rack in which commodities are displayed or just prior to placing the articles on display. A system which is now called POS (point of sale) has recently come into use. In that system bar codes are used to provide information. However, the following problems arise in the printing and applying operation of bar code labels:

(1) Strict accuracy in the widths and spacings of bar code lines are required because the bar codes are read by means of an optical reader. However, the printing head mounted on a portable label printing and applying machine is generally simple in structure so that structural aberration of the printing head is liable to occur. In addition, the application of ink with an inking roller applied to the set up typeface structure for transfer to the label often results in irregular application of ink or application of too much or too little ink. As a result, bar codes are not accurately printed and they are often read incorrectly by an optical reader.

(2) Since the sizes of bar codes are standardized and the elements are larger than those of ordinary characters, the size of bar code printing head becomes larger than that of a printing head for ordinary characters. As a result, the portable label printing and applying machine must be made large in size and weight, which creates handling problems and fatigue in operation.

(3) Check digits are necessary for bar codes. However, the size and structure of the portable label printing and applying machine are limited so that it is difficult to provide the machine with an automatic calculating mechanism. Therefore, the check digits must be calculated separately and be set in the printing head, which is also disadvantageous in practical operation.

Since the portable label printing and applying machines for bar codes had the foregoing problems, the label printing and applying operation was carried out also by printing the labels on the label strip by using a table printing machine. The printed labels were then peeled off one by one by hand and applied to articles. However, this manual applying method reduced the work efficiency and the printed information on labels was often soiled or blurred because the label surfaces were rubbed by the fingers which manually applied the labels.

Accordingly, an apparatus which is capable of performing properly the printing and applying operation of bar code labels in an accurate and efficient manner has not been previously available although the need therefor has been substantial.

Besides the above-described label printing and applying machine, portable label applying machines of another type are widely used, in which the printing function of the former label printing and applying machine is omitted. These label applying machines are used for applying labels which are not printed or have been previously printed by a separate printing machines with indications, for example, for sales promotion such as "Special Sale", "Bargain", "New Sale", "30% Discount", etc. In the label applying machines of this type, the replacing of a label strip is quite troublesome and takes much time. That is, the label replacing must be carried out by first obtaining access to some portion of the run or path of the label strip. The bottom cover of the portable label device is lifted, the label strip is then pulled out and it is detached from the supporting section, a new rolled label strip is then mounted on the supporting section, the label strip is next threaded through the desired path to set the label strip in the machine and the bottom cover is closed.

Where such label replacement has become a problem, the solution to the problem was the use of a plurality of label applying machines set with several kinds of labels. This is quite uneconomical.

Accordingly, it has also been desired to provide an improved label applying machine in which label replacement can easily and quickly be performed and which machines can be produced at low cost.

BRIEF SUMMARY OF THE INVENTION

The object of the present invention is to overcome the said problems of the prior art and to provide an improved portable label applying machine which is free from the foregoing disadvantages and can satisfy the foregoing demands.

Another object of the present invention is to provide a portable label applying machine for applying labels to articles in which the label applying operation can be done rapidly with reduced operator fatigue.

A further object of the present invention is to provide a portable label applying machine in which the operation of replacing the type of label to be applied is performed more easily and rapidly than in prior label applying machines.

Still a further object of the present invention is to provide a portable label applying machine which is simple in structure providing simplicity in manufacture and long service life for the machine.

Another object of the present invention is to provide a portable label applying machine for applying labels to articles, which labels have been previously printed accurately with bar codes and check digits.

Still a further object of the present invention is to provide a portable label applying machine which does not blur, smudge or soil printed labels when they are applied to articles.

Another object of the present invention is the provision of a detachable replaceable label cassette which is self-contained and provides all the elements for guiding a label strip when the strip is driven by the applying machine.

The portable label applying device of the present invention detachably holds a label cassette which contains a rolled label strip on which a plurality of labels are removably positioned on a web of backing paper. The cassette also has a peeling section which bends the backing paper to peel off the labels. The applying device is provided with a feeding mechanism to shift the bent backing paper and peel off the labels and an applying section serviceable for applying the peeled labels to articles. A plurality of such label cassettes with preprinted bar code lables may be interchageably used with a single label applying machine according to the invention. Each such cassette may be inserted with the bent backing paper along a guide section on one side of the cassette. Because the feeding mechanism of the label applying machine projects toward the guide section of the cassette, the backing paper will be engaged by the feeding mechanism and labels may be applied without further threading of the label strip through the applying machine.

Other objects, features and advantages of the invention will become apparent from the following description of the preferred embodiments of the invention in conjunction with the accompanying drawings and appended claims.

DESCRIPTION OF THE PREFERRED EMBODIMENTS

Figure 1:
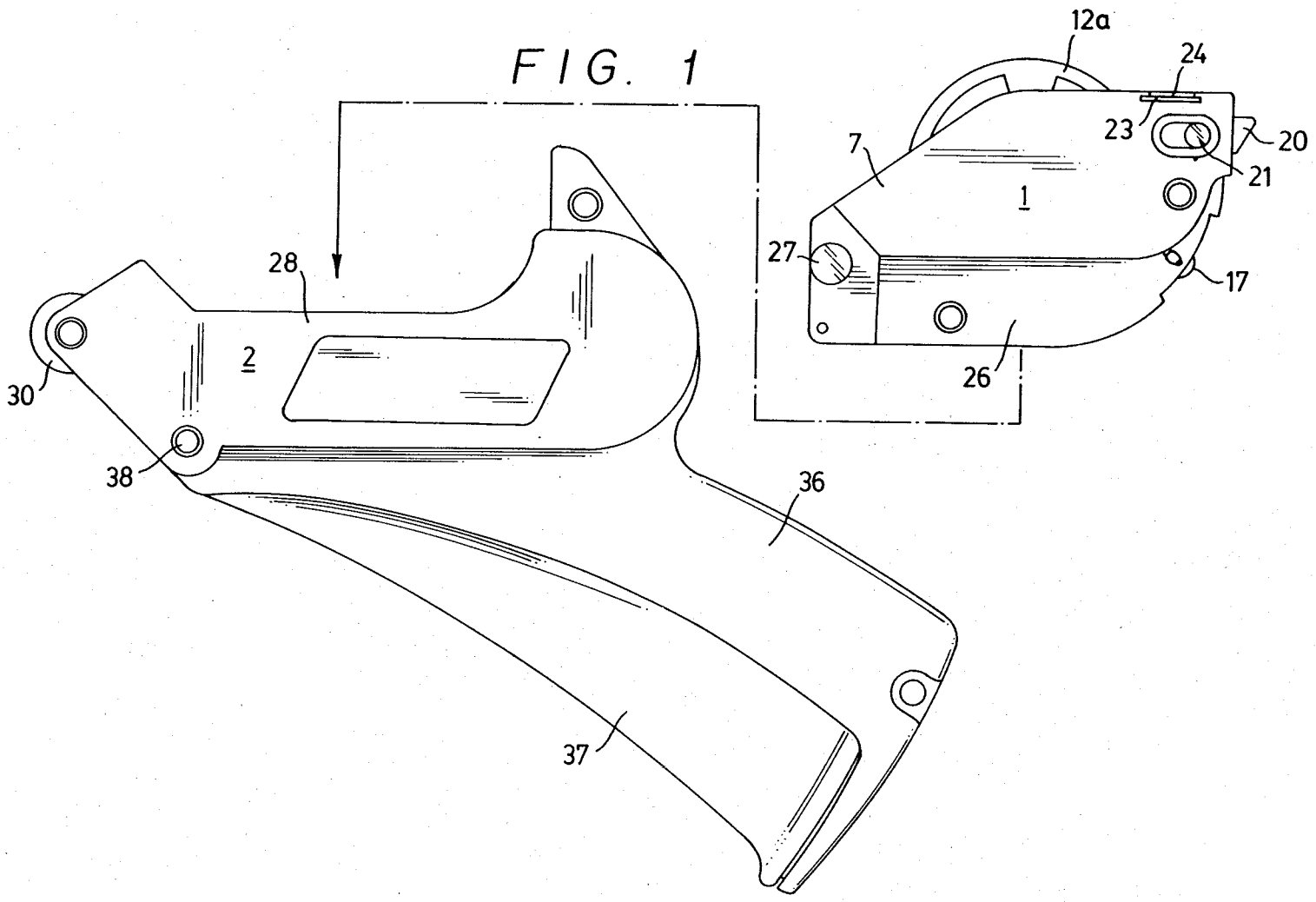
FIGS. 1 and 2 are side and cross-sectional views, respectively, showing one embodiment of the label applying machine of the invention with a label rolling cassette for use therewith.

A first embodiment of the present invention will now be described with reference to FIGS. 1 and 2.

Figure 14:
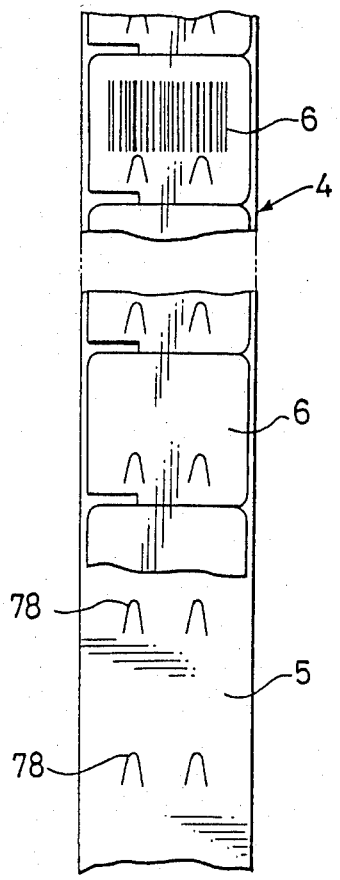
FIG. 14 is a plan view of a label strip on which bar codes are to be printed.

The label applying machine 2 according to the present invention holds a label rolling cassette 1 for rolling up a composite label web 4 which has been printed with indicia, such as bar codes, by the action of a printer (not shown). The label applying machine 2, to which that label rolling cassette 1 is removably attached, can be manually operated to feed the composite label web 4 and to delaminate labels 6, shown in detail in FIG. 14, one by one from a web of their backing paper 5, thereby to bring those labels 6 into an appliable state.

In the center portion of the frame 7 of the label rolling cassette 1, a rolling core 8 having a cylindrical shape is rotatably fitted. At each of four equidistantly spaced portions of the outer circumference of the rolling core 8, there are a recess 9 and a clamping spring 10 which clamp the leading end of the composite label web 4 when the web is being rolled.

A rotary bail 12 is hinged to a pair of annular lands (not shown) which are formed on the facing inner walls of the frame 7 outside of the roling core 8. The rotary bail 12 is formed at the rear portions of both its side walls with a pair of sideways label web looseness preventing plates **12*a*, which are provided to prevent the composite label web 4 rolled on the core 8 from being loosened sideways. The front end of the bail 12 has a semi-circular label holding portion 13** which merges into both side plates thereof.

Figure 2:
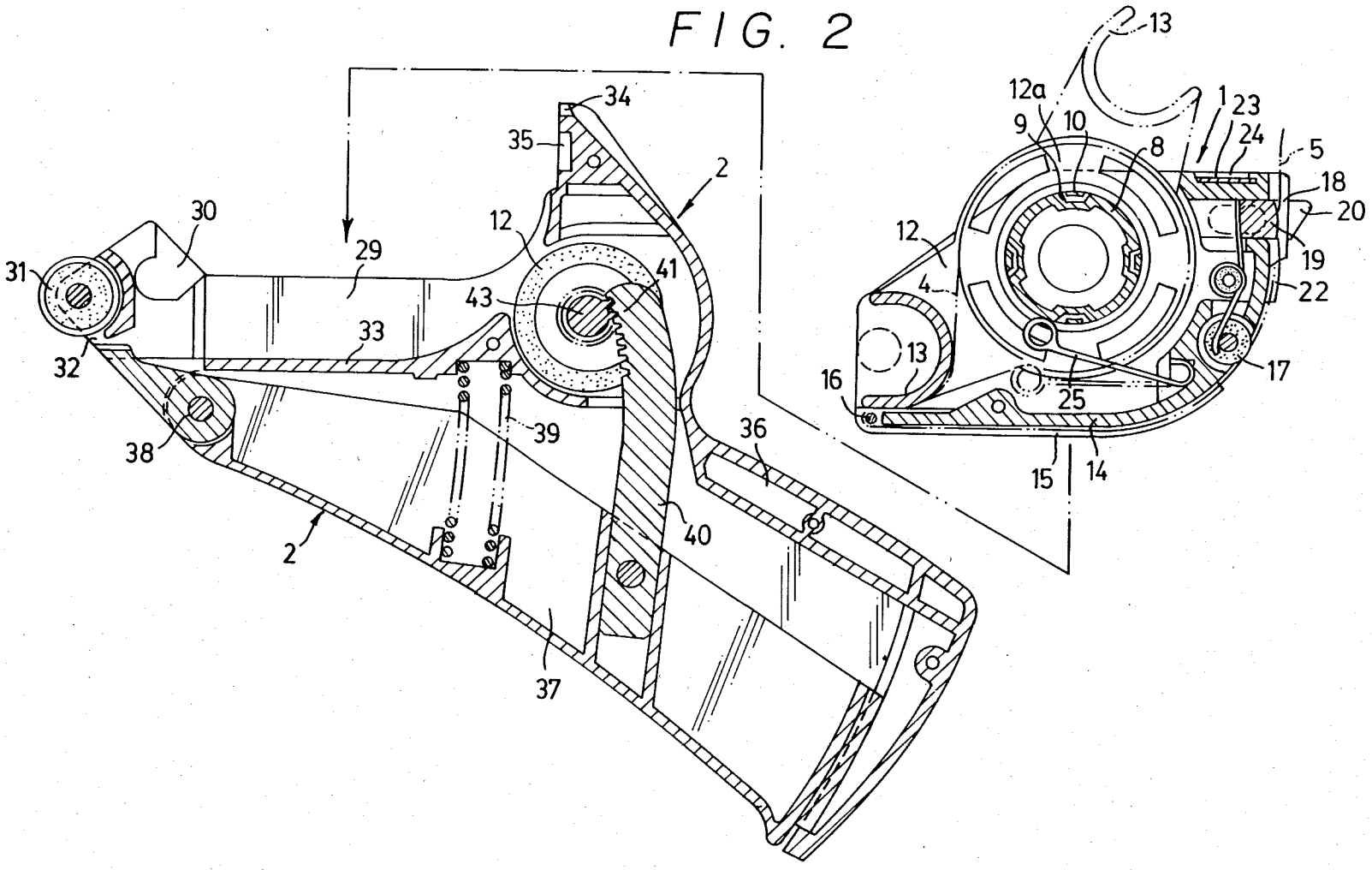

The label rolling cassette 1 is gently curved up from its bottom side at the left or front in FIG. 2 to its right or rear end to form a curved guide plate 14 with a lower side that is formed wth a backing paper guide groove 15 extending from the front end to the rear end.

The guide plate 14 has a turning pin 16 at its front end for turning the backing paper web 5 from the composite label web 4. Midway along the guide plate 14, a subroller 17 is rotatably attached. Its outer circumference protrudes slightly for feeding the backing paper web 5 in cooperation with the feed roller 42 of the label applier 2, as described below.

A pair of backing paper holding plates 18 protrude from the frame 7 into the backing paper guide groove 15. A hook member 19 is slidably received in the rear end of the frame 7. The hook member 19 is formed with a pair of right and left protruding hooks 20 at its rear portion and with a pair of knobs 21 at both of its right and left ends. The hook member 19 is continuously biased rearwardly by a torsion spring 22 so that the hooks 20 usually protrude from the rear side of the frame 7.

The frame 7 is formed in the upper side of its rear portion with a recess 24 for receiving an indication plate 23. An elastic member 25 is disposed below the rolling core 8 for preventing the rolled up composite label web 4 from becoming slack. The label rolling cassette 1 is slightly recessed at the outer sides of its lower portion between the sides of the frame 7 to form an attachment portion 26, at which the cassette is attached to the label applying machine 2. The frame is formed with round engaging lands 27 at both sides of the front end of the attachment portion 26.

The label applying machine 2 includes a frame 28 which is recessed at its upper portion to form a receptacle 29 in which the attachment portion 26 of the label rolling cassette 1 is to be placed and received. The front end of the receptacle 29 is formed in both its sides with recesses 30 which engage with the engaging lands 27 of the label rolling cassette 1. A label applying roller 31 is rotatably pivoted to the front end of the frame 28. Below the roller 31, a label exit 32 is opened.

The bottom of the receptacle 29 is defined by a curved guide plate 33 which corresponds in shape to the guide plate 14 of the label rolling cassette 1. That guide plate 33 has a rear portion which at its upper end carries a backing paper cutter 34. Below the backing paper cutter 34, the guide plate includes a pair of hook holes 35 for receiving the hooks 20 of the label rolling cassette 1.

The lower portion of the frame 28 extends obliquely backward to provide a grip 36. Below the grip 36, a hand lever 37 is swingably disposed. The leading end of the hand lever is attached to the frame 28 by a pivot pin 38. A return spring 39 is disposed in the hand lever 37. The upper end of the spring 39 abuts against a portion of the frame 28 so that the hand lever 37 is always biased clockwise (i.e. downward). An actuating lever 40 has a lower end that is fixed to the hand lever 37 and has an upper end formed with a rack 41. The rack 41 is positioned and sized to mesh with the pinion 43 of the feed roller 42 which is fitted in the frame 28. The feed roller 42 is equipped with a built-in one-way clutch mechanism (not shown), so that it is adapted to rotate only in the clockwise direction in FIG. 2. As a result, only the pinion 43 is rotated when the hand lever 37 is squeezed to lift the actuating lever 40. When the hand lever 37 is released, on the contrary, the feed roller 42 is rotated clockwise together with the pinion 43.

The outer circumferential portion of the feed roller 42 is made of an elastic material, such as rubber, and the portion then at the guide plate 33 is exposed to the outside at the opening formed in the plate 33. The feed roller engages the backing paper web and pulls it to the rear.

The operation of the foregoing embodiment is now described with reference to FIGS. 1, 2 and 3.

The cassette 1 is first set in the label applying machine 2. The cut off, leading end of the composite label web 4 is extracted, pulled forward to, and turned rearward around the front of the turning pin 16 at the front end of the cassette 1 and is then guided to extend along the guide groove 15 of the bottom guide plate 14 and then upward between the backing paper holding plates 18, shown in FIG. 2. Then, the rotary bail 12 is rotated counterclockwise to its solid line position in FIG. 2 so that the label holding portion 13 thereof abuts the composite label web 4. This guides the web to move straight forward to the pin 16, making the rearward turn around the pin 16 a sharp turn for facilitating label separation.

Figure 3:
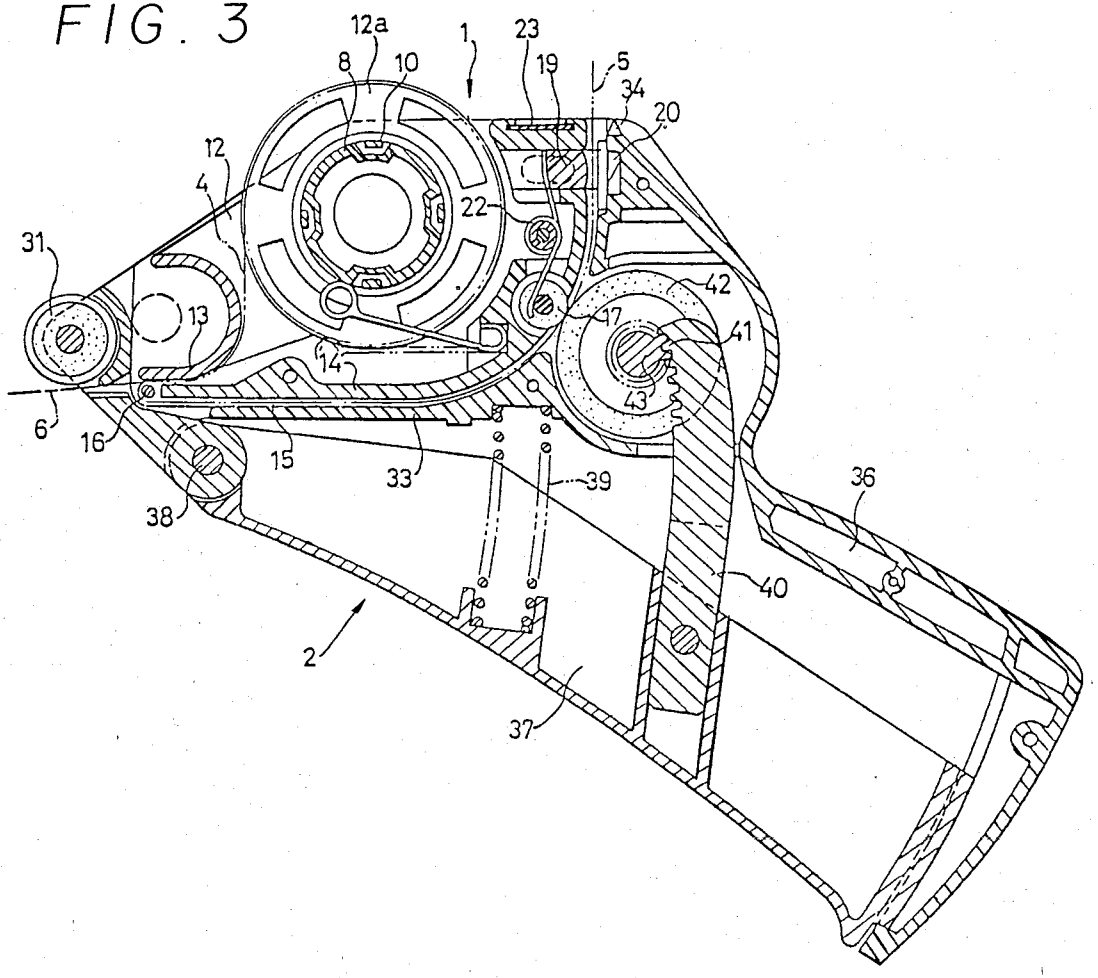
FIG. 3 is longitudinal cross-sectional view showing the label rolling cassette attached to the label applying machine of FIGS. 1 and 2.

Next, the attachment portion 26 of the cassette 1, is attached to the receptacle 29 of the label applying machine 2, while the engaging lands 27 at the front end of that cassette 1 engage with the recesses 30 of the receptacle 29, until the hooks 20 come into engagement with the hook holes 35 (as shown in FIG. 3). By this setting step, a backing paper passage at the guide groove 15 is formed between the guide plate 14 of the cassette 1 and the guide plate 33 of the label applying machine 2, and the sub-roller 17 is moved to abut against the feed roller 42 to clamp the backing paper web 5 between them.

If the hand lever 37 is squeezed at this stage, the actuating lever 40 is moved upward so that its rack 41 rotates the pinion 43. However, the feed roller 42 cannot be rotated due to the one-way clutch mechanism. If the hand lever 37 is now released, the actuating lever 40 is moved down together with the hand lever 37 by the return spring 39 so that the feed roller 42 is rotated a predetermined angle in the clockwise direction together with the pinion 43. The backing paper web 5 is fed upward in accordance with the rotation of the feed roller 42 because it is clamped between the feed roller 42 and the sub-roller 17.

Only the backing paper web 5 is turned back around the pin 16 at an acute angle while the composite label web 4 at the turning pin 16 is held at a horizontal orientation by the label holding portion 13. As a result, the labels 6 are advanced to the left in FIG. 3, while being delaminated from their backing paper web 5, until the labels are fed to a position below their applying roller 31 through the label exit 32.

The labels 6 are applied to articles by the label applying roller 31 when the underside (i.e. the adhesive side) of the label 6 then below the applying roller 31 is applied to and rubbed against an article, similarly to what is done with the usual hand labeler.

The feed means for feeding the backing paper web 5 need not be limited to the combination of the feed roller 42 and the sub-roller 17. It can be a combination of perforations formed in a backing paper web and feed pins on the feed roller engaging with the perforations.

Referring now to FIGS. 4–13, an alternative embodiment of the portable label applying machine of the present invention will be described in detail. The same reference numerals are used for equivalent parts found in the first embodiment, above.

Figure 8A:
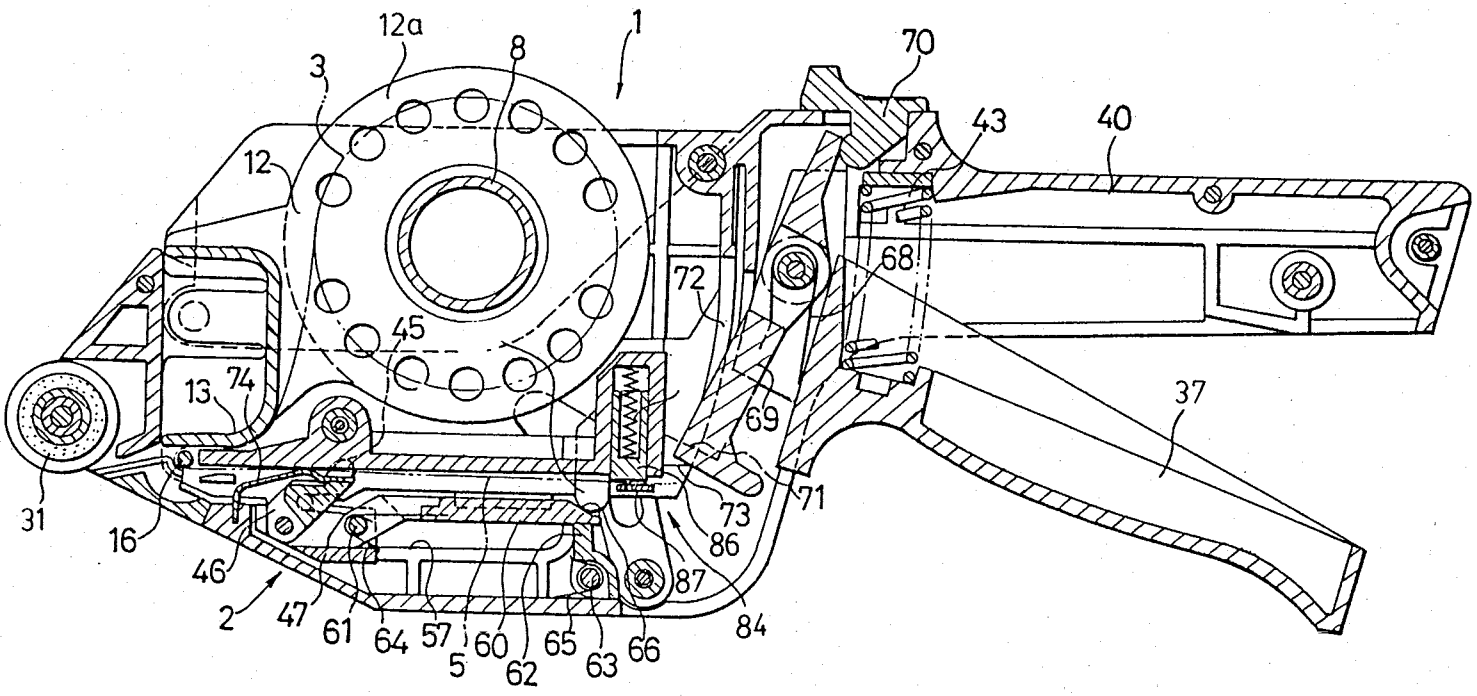
FIG. 8A is a longitudinal cross-sectional view of the portable label applying machine of FIG. 4 on which the label cassette is removably mounted.

The label printing machine comprises a label cassette 1 and an applying device 2 as in the first embodiment. The label cassette 1 supports a roller label strip 3, as shown in FIG. 8A.

The cassette 1 can be detachably mounted on the applying device 2. The applying device 2 advances the tape-like label strip 3 by manual operation and peels labels 6, shown in FIG. 14, from a backing paper 5, thereby bringing the label 6 into a condition and a position to be applied.

A supporting cylinder winding core 8 is provided to support the rolled label strip 3 and is rotatably attached to a machine frame 7 on one side of the label cassette 1. The label strip 3 may be secured to the winding core 8 in any suitable manner.

Figure 11:
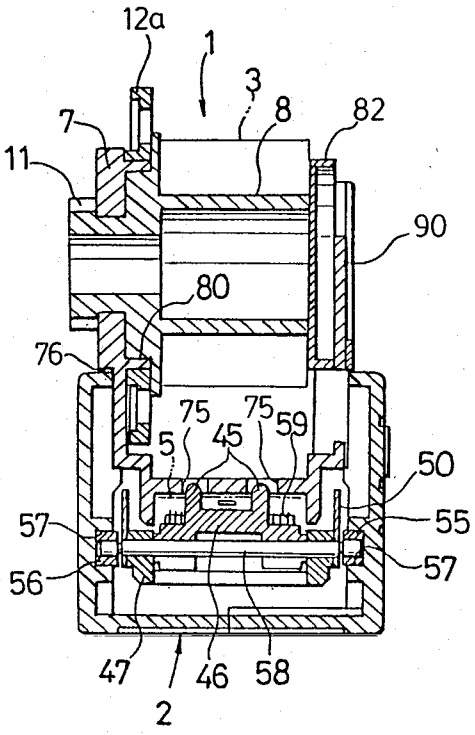
FIG. 11 is also a transverse cross-sectional view of the portable label applying machine taken along the line B—B in FIG. 9.

As shown in FIG. 11, one side of the supporting cylinder or core 8 is provided with a toothed wheel 11 of small diameter which is located outside the machine frame 7. A bail or turning member 12 is pivotally supported by a circular projection 80 which is formed on the inside of the machine frame 7. Its rear side wall serves as a supporting plate 12*a* which prevents the rolled label strip 3 on the cylinder 8 from loosening and moving or spilling to one side. When desired, a pair of circular plates 12*a* may be used further to control the coiled strip 3.

In the front portion of the turning member 12, there is provided a label pressing or holding member 13.

A closing plate 90 is attached to one side of the machine frame 7 by a pin 81 and can be opened and closed. An indication card holder 92 is formed in the outside wall of the closing plate 90. On the inside wall of the closing plate 90, there is provided a circular push plate 82 in the middle portion, as shown in FIG. 11.

Figure 5:
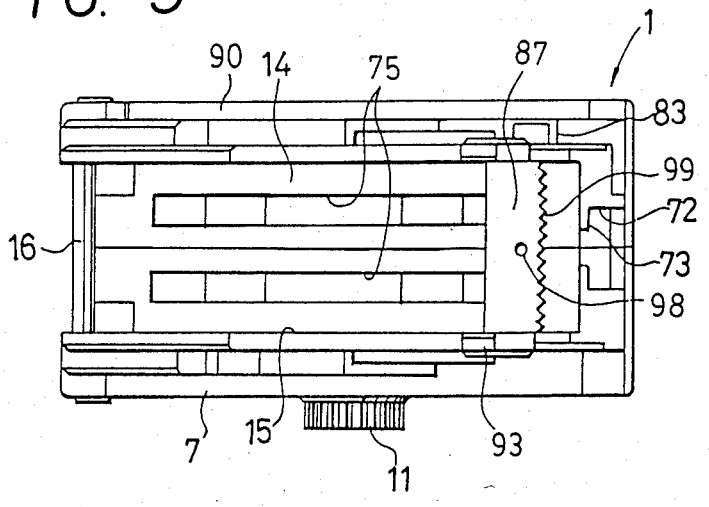
FIG. 5 is a bottom view of a cassette to be used with the embodiment of FIG. 4.

As shown in FIG. 5, a backing paper guide groove 15 is formed from the front end to the rear end of the bottom face of the label cassette 1. As shown in FIG. 5, a pair of pawl guides 75 are formed extending longitudinally in the bottom guide plate 14. A bending pin 16 for bending the backing paper 5 is attached in front of the bottom guide plate 14. A backing paper pressing mechanism 18 is formed in the rear portion of the bottom guide plate 14.

Figure 10:
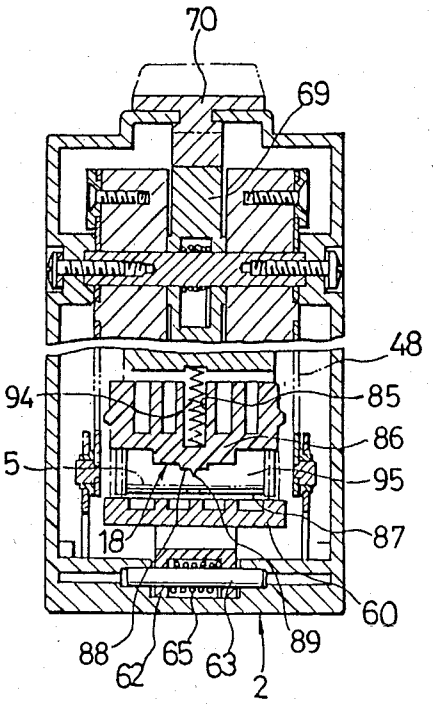
FIG. 10 is a transverse cross-sectional view of the portable label applying machine taken along the line A—A in FIG. 9.
Figure 12:
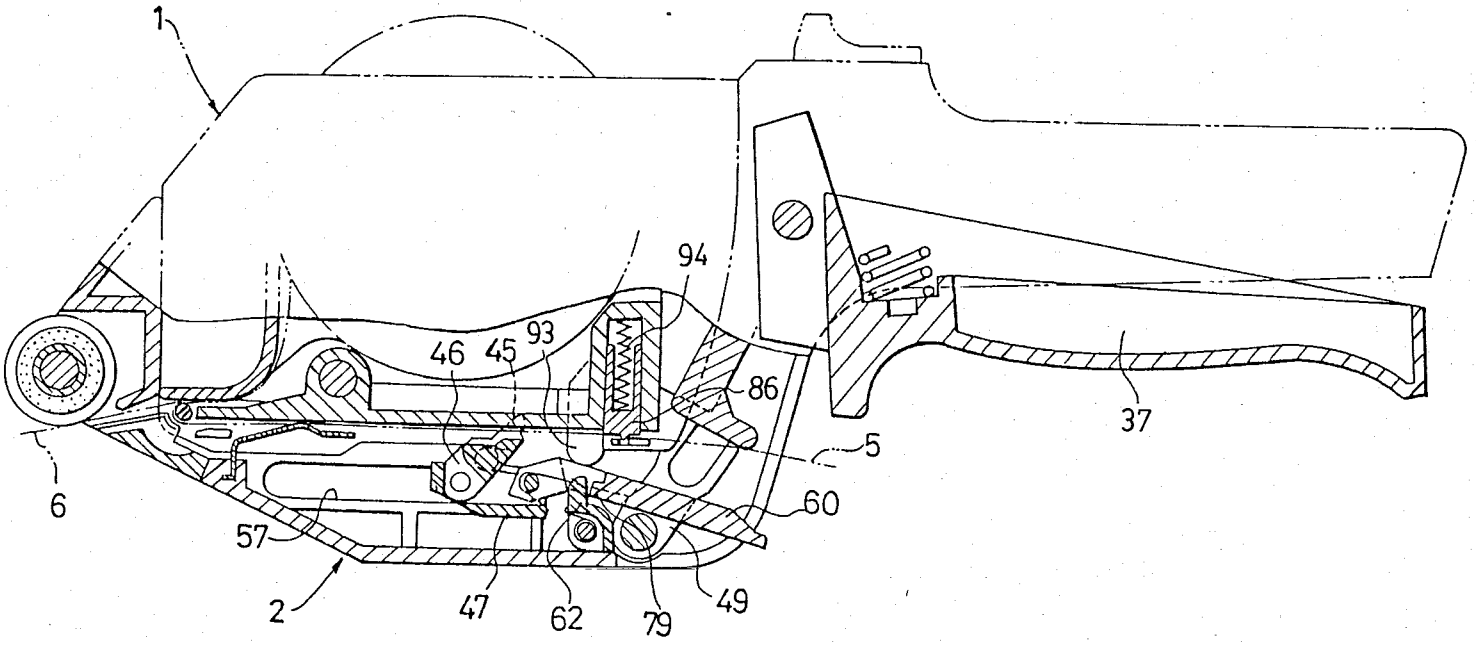
FIG. 12A is a longitudinal cross-sectional view of the main part of the portable label applying machine of FIG. 4 in which the hand lever is fully squeezed.
FIG. 12B is a side elevation view of the portable label applying machine of FIG. 4 in which the machine frame on the near side is removed.
Figure 12:
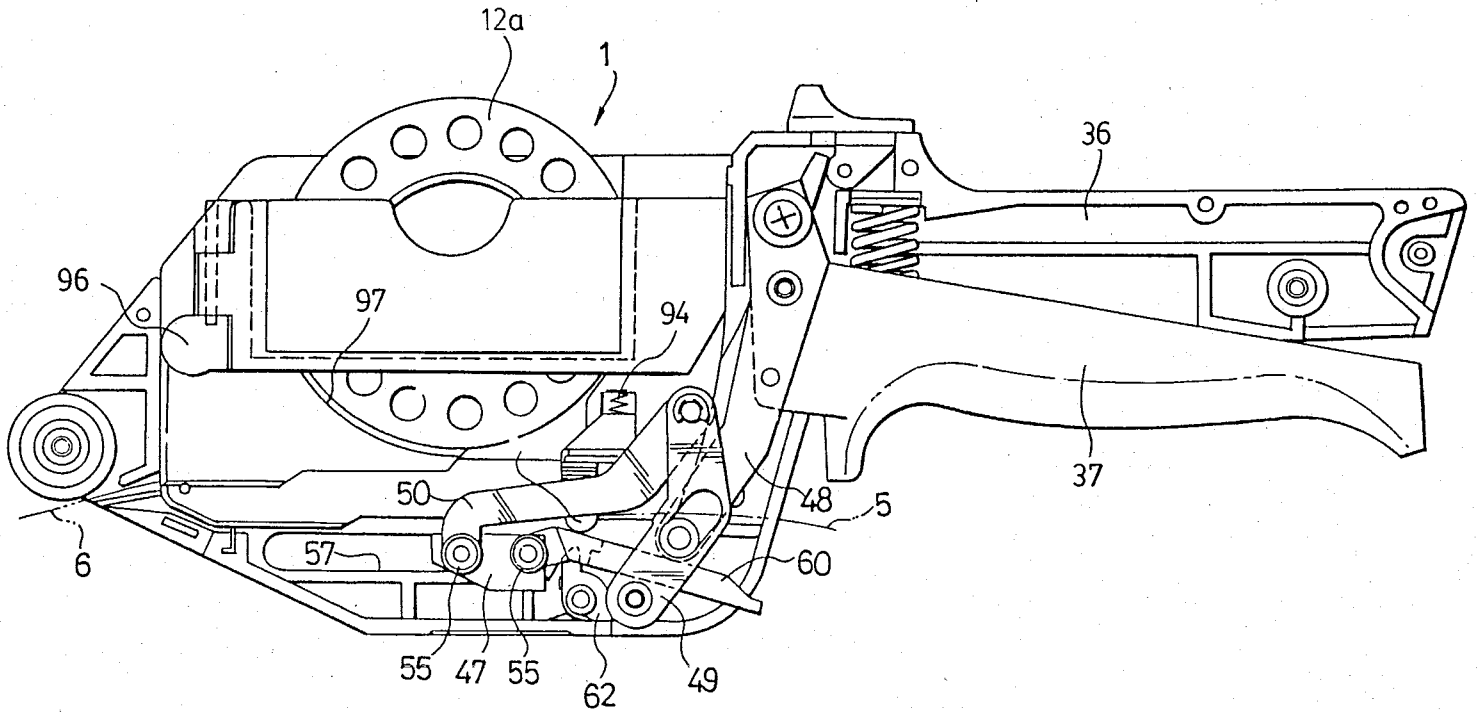

The backing paper pressing mechanism 84, shown in FIG. 8A, comprises a pressing member and a counter plate 87 which is attached to the rear end of the backing paper guide groove 15. The pressing member 86 is vertically slidably fit in a recess 85 which is formed in the frame 7. As shown in FIG. 10, pressing porton 88 is formed on the bottom face of the pressing member 86. A needle 89 protrudes from the center of the underside of the pressing portion 88.

The pressing member 86 is integrally provided on both sides thereof with a pair of finger plates. The lower end of each finger plate is provided with a semi-circular tongue piece 93. The pressing member 86 is biased downward by a spring 94 which is held within the recess 85. As a result, the tongue pieces 93 normally protrude from the bottom face of the label cassette 1 and the pressing portion 88 is brought into contact with the upper face of the counter plate 87.

The counter plate 87 is so attached that a space 95 sufficient to pass the backing paper 5 therethrough is left between the counter plate 87 and the bottom plate 14. An aperture 98 to receive the needle 89 of the pressing member 86 is defined at the center of the counter plate 87. On the rear edge of the counter plate 87, a cutter 99 for cutting the backing paper 5 is provided as shown in FIG. 5.

Semicircular engaging projections 96 are formed on both side front ends of the label cassette 1, as shown in FIG. 12B. The lower parts on both sides of the label cassette 1 form slightly retreated mounting portions 97 which are serviceable when the label cassette 1 is attached to a printing device (not shown).

Figure 4:
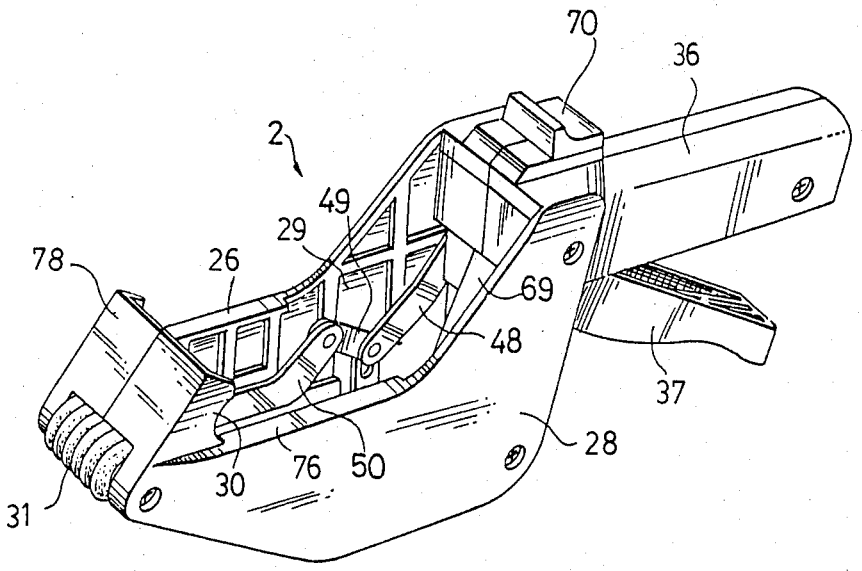
FIG. 4 is a perspective view of an alternative embodiment of the label applying machine of the present invention.

The applying machine 2 will be described with reference to FIGS. 4, 6 and 7. The upper part of the inside of the machine frame 28 is a receiving section 29 to receive therein the label cassette 1. The upper horizontal edges of the machine frame 28 constitute a supporting section 76 which protrudes a little inward. In the rear side of each front wall 78 of the machine frame 28, a semicircular engaging recess 30 is formed. Further, an applying roller 31 is rotatably secured to the front end of the machine frame 28 and a label exit 32 is opened under the roller 31.

The rear portion of the machine frame 28 is elongated to form a hand grip 36. A hand lever 37 is pivotally secured to a pivot shaft 38 and under the hand grip 36. Between the hand grip 36 and the hand lever 37 is fitted a return spring 39, thereby urging the hand lever 41 in the clockwise direction.

A feeding mechanism 44 for advancing the backing paper 5 is formed in the lower portion within the machine frame 28. The feeding mechanism 44 comprises a pawl member 46 having a pair of feeding pawl 45 on its upper side, a supporting frame 47 to support the pawl member 46, and first, second and third links 48, 49 and 50 which move the supporting frame back and forth.

One end of the first link 48 is fixed to the hand lever 41 and the other end of the link 48 is provided with a roller 51 which is fitted into a slot 52 that is formed in the second link 49. The lower end of the second link 49 is pivotally secured to a pin 53 which is horizontally disposed between the side walls of the machine frame 28. The upper end of the second link 49 is pivotally linked to a pivot pin 54 which is disposed in one end portion of the third link 50 and the other end of the third link 50 is fixed to the supporting frame 47.

Figure 7:
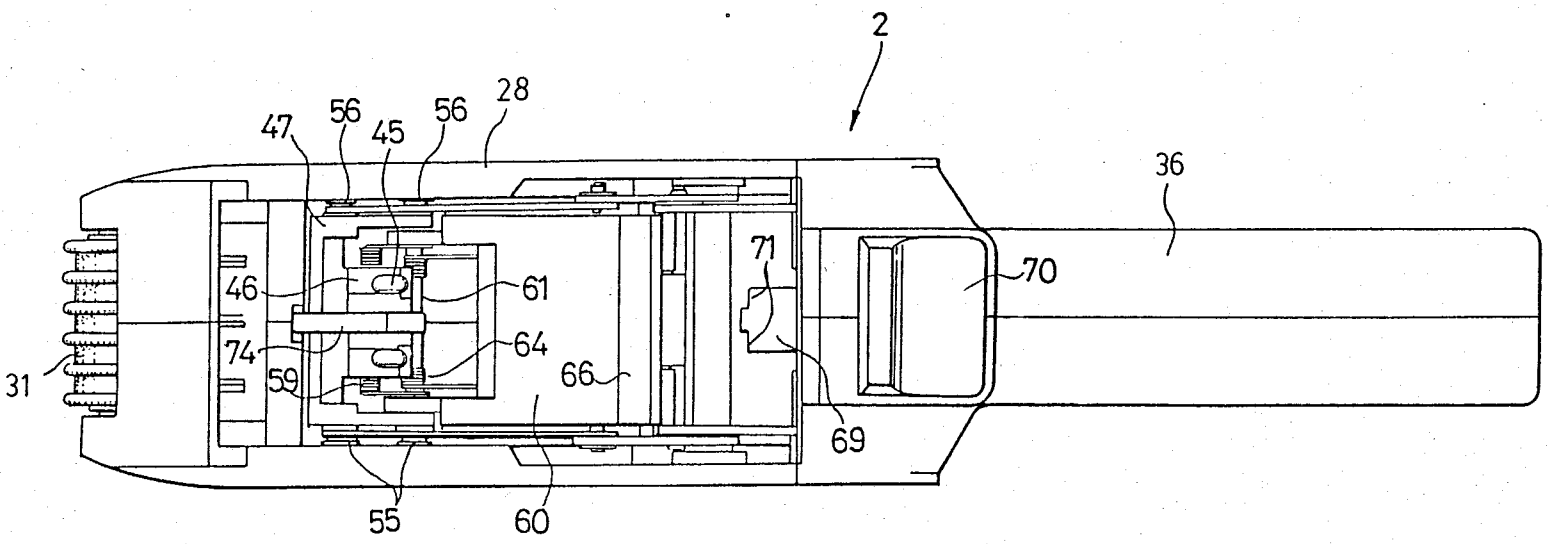
FIG. 7 is a plan view of the same.
Figure 9:
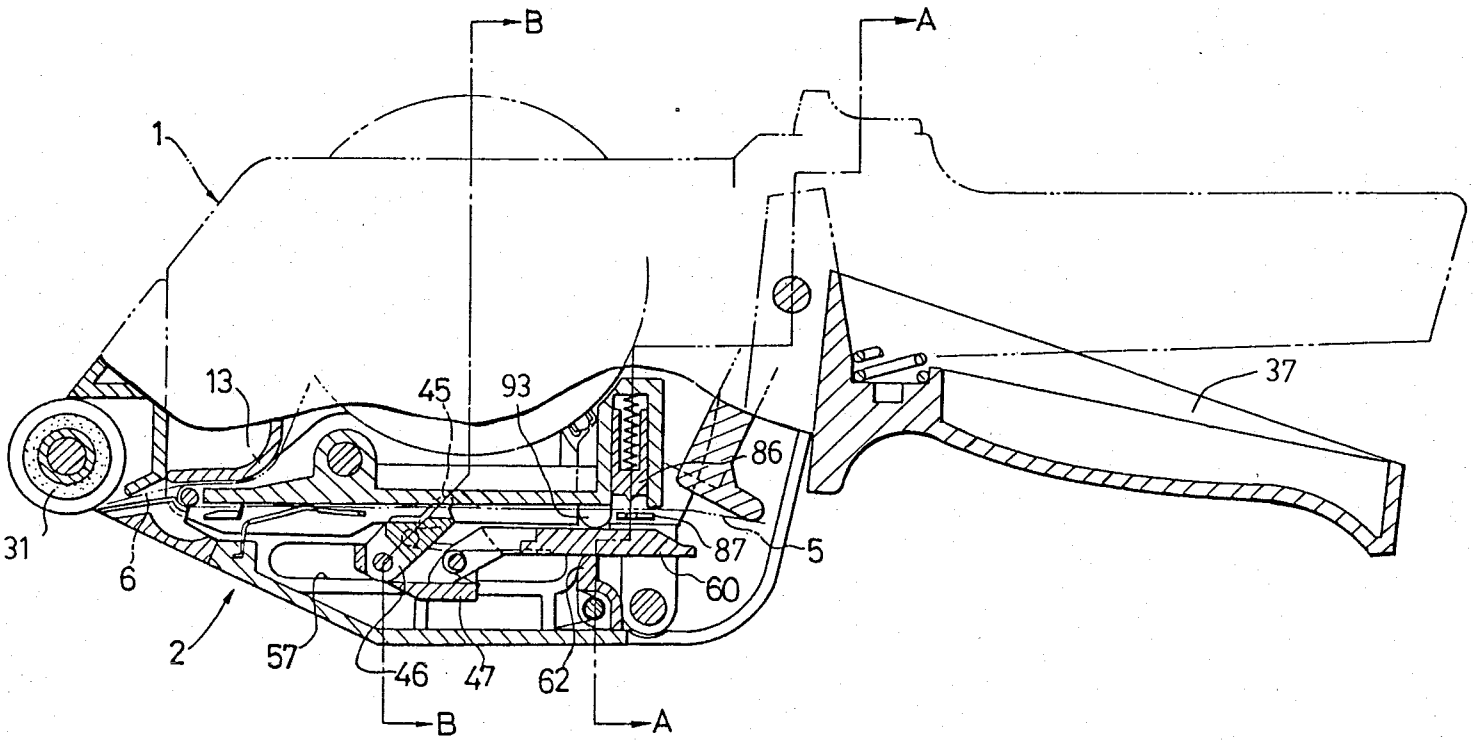
FIG. 9 is a longitudinal cross-sectional view of the main part of the portable label applying machine of FIG. 4 in which the hand lever is partway squeezed.

The supporting frame 47 is U-shaped as shown in FIG. 7 and is provided on both sides with a pair of rollers 55 and 56. Rollers 55, 56 are fitted into guide grooves 57 which are formed in the inside walls of the machine frame 28, as shown in FIG. 9.

The pawl member 46 is pivotally supported by pin 58 which is horizontally disposed in the supporting frame 47. The pawl member 46 is normally urged by springs 59 in a counterclockwise direction with respect to FIG. 6.

A push-up plate 60 is pivotally supported by a pin 61 which is horizontally disposed in the rear portion of the supporting frame 47 and a supporting member 62 is pivotally supported by a pin 63 which is horizontally disposed between the side walls of the machine frame 33. The former push-up plate 60 is urged counterclockwise by a spring 64 and the latter supporting member 62 is urged clockwise by a spring 65 as viewed in FIG. 6. A tapered portion 66 is formed in the upper rear portion of the push-up plate 60. In the rest condition shown in FIG. 8A, the undersurface at the rear of the push-up plate 60 is supported by the top face of the supporting member 62.

Figure 6:
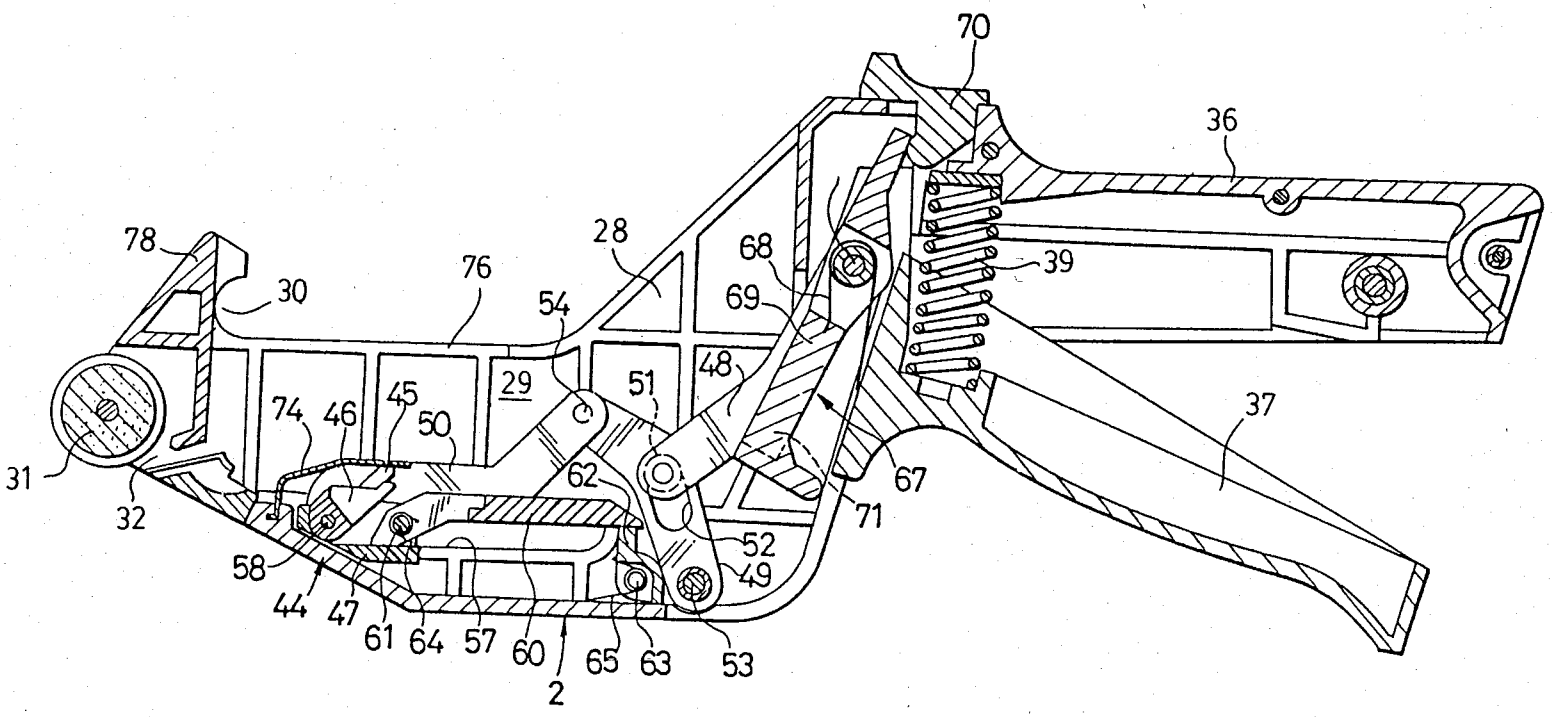
FIG. 6 is a general view in longitudinal cross-section of a portable label applying machine.

As shown in FIG. 6, a locking mechanism 67 is disposed in the rear portion of the machine frame 28, which mechanism 67 locks the label cassette 1 when it is attached to the machine frame 28. The locking mechanism 67 is comprised of a locking member 69 and a release button 70. The locking member 69 is pivotally secured to the machine frame 28 and is normally urged clockwise by a spring 68. The release button 70 is reciprocally slidable at the upper rear end of the machine frame 28 and a portion of the button 70 is in contact with the locking member 69. When the label cassette 1 is mounted on the applying device 2, the lower edge portion 71 of the locking member 69 comes into engagement with the engaging portion 73 at the loer end of the opening 72 formed in the rear side of the label cassette 1, as shown in FIGS. 7 and 8A.

A backing paper pressing plate 74 which is made of a leaf spring is attached to the machine frame 28 in front of the aforesaid pawl member 46.

The operation of the label applying machine of the present invention will be described in the following.

There are two methods of operation in which the label applying machine of the present invention may be used. In one method of operation, a previously printed rolled label strip or an unprinted rolled label strip is attached to the label cassette 1. In another method of operation, the label cassette 1 is detachably mounted on a printing device (not shown) and a label strip is printed and automatically wound on the supporting cylinder 8 to be used.

In the first method of operation, the closing plate 90 in the side face of the label cassette 1 is opened, the rolled label strip 3 is attached to the supporting cylinder 8 and the closing plate 90 is closed. Then, the turning member 12 is stood upright with its label pressing portion 3 located at the top. The free end portion of the label strip 4 is pulled out to a desired length and several labels 6 are peeled off. The remainder of the backing paper 5 is bent rearward over the front face of the bending pin 16 and the free end of the backing paper 5 is inserted into the space between the pressing portion 88 and the counter plate 87. More particularly, when the finger plates are slid up with the fingers, the whole of the pressing member 86 moves upward. The backing paper 5 is then inserted into the space between the pressing portion 88 and the counter plate 87 and, when the fingers are released, the pressing member 86 is moved down by the force of the spring 94. Thus, the backing paper 5 is pinched between the pressing portion 88 and the counter plate 87. In addition, the needle 89 enters the backing paper 5 to secure the backing pper 5. Next, the upright turning member 12 is turned back to the original position and the label pressing portion 13 is brought into contact with the label strip 4.

Figure 8B:
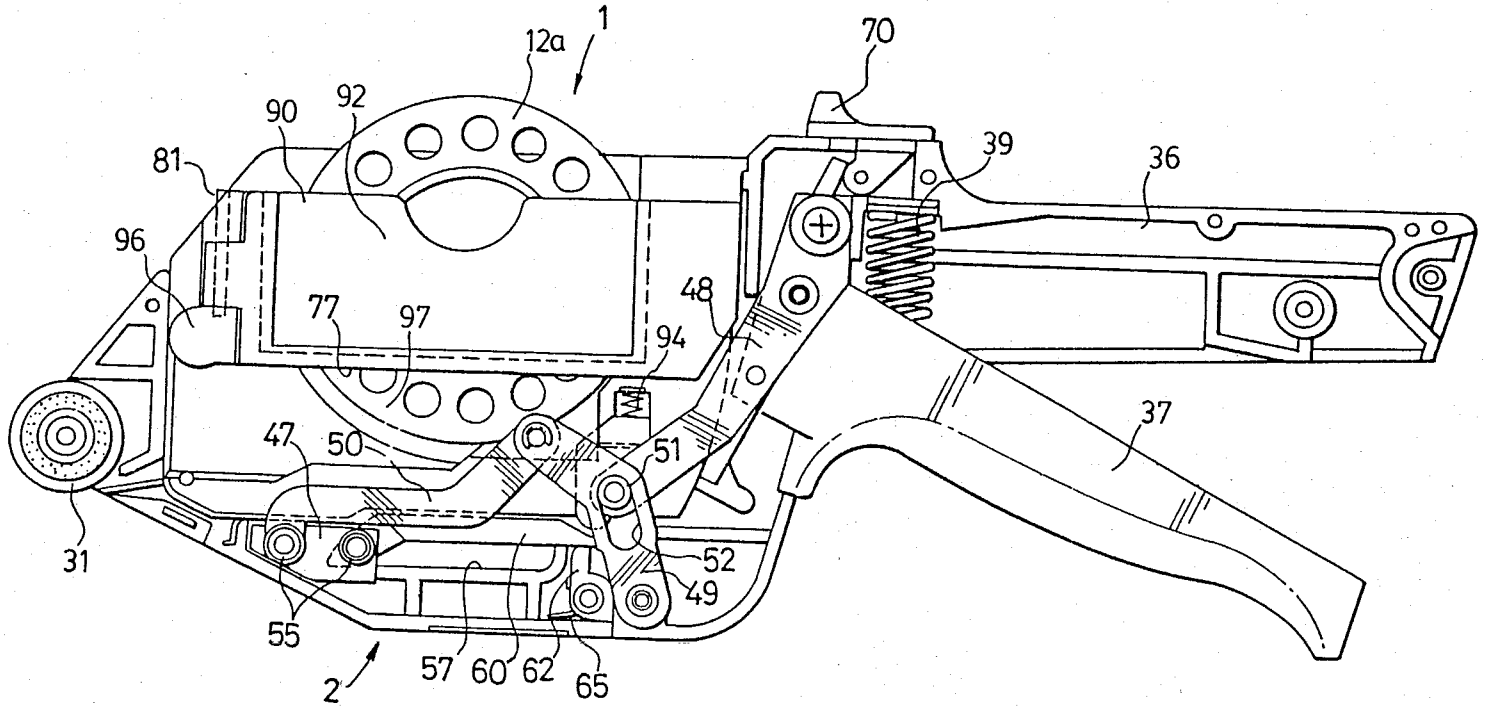
FIG. 8B is a side elevation view of the portable label applying machine of FIG. 4 in which a machine frame on the near side is removed.

In the next step, the engaging projection 96 of the label cassette 1 is brought into engagement with the engaging recess 30 of the applying device 2 and the mounting portion 97 of the label cassette 1 is fitted into the receiving section 29 of the applying device 2. As a result, the raised portion 77 formed on both sides of the cassette 1 is held by the supporting section 76 of the applying device 2 and the label cassette 1 is automatically secured by the locking mechanism 67. At one side, the portion 77 is the underside face of the closing plate 90. When the label cassette 1 is mounted, the engaging portion 73 moves downward upon the turning of the locking member 69 counterclockwise against the force of the spring 68. When the engaging portion 73 passes over the lower edge portion 71 of the locking member 69, the locking member 69 is returned to its original position, to lock by the engagement between the lower edge portion 71 and the engaging portion 73, as shown in FIGS. 8A and 8B.

When the hand lever 37 is then squeezed, the supporting frame 47 is horizontally moved backward along the guide groove 57 by the linkage comprising the first, second and third links 48, 49 and 50 (FIG. 9). The feeding pawls 45 of the pawl member 46 are in engagement with the feeding slits 78 (FIG. 14) which are formed at regular intervals in the backing paper 5, so that, in this operation, the backing paper 5 is also moved rearward. At the same time, the push-up plate 60 pushes up the engaging tongue piece 93 of the pressing member 86. As a result, the holding functions being performed by the pressing portion 88 of the pressing member 86 and the needle 89 are released. The backing paper 5 is thus smoothly shifted rearward and paid out from the machine body.

When the hand lever 37 is further squeezed as shown in FIGS. 12A and 12B, the push-up plate 60 is moved rearward and the engagement between the underface of the push-up plate 60 and the supporting member 62 is released. Therefore, the pressing member 86 is moved down to its original position by the force of the spring 94. This pushes down the push-up plate 60 clockwise and the backing paper 5 is again fixed by the pressing portion 88 and the needle 89.

In this shifting of the backing paper 5, only the backing paper 5 of the label strip 4 is bent backward at a sharp bend as the label strip 4 is horizontally depressed by the label pressing portion 13 at the turning pin 16 in the front portion of the machine body. In this bending of the backing paper 5, the label 6 is advanced and is peeled off the backing paper 5 to be delivered to the underside of the applying roller 31 through the label exit 32.

The manner of application of a label 6 to an article is the same as that in a conventional portable label printing and applying machine. That is, the adhesive carrying undersurface of the label 6 which is then held under the applying roller 31 is brought into contact with the surface of an article and the label is rubbed and applied by the applying roller 31.

When the hand lever 37 is released, it is returned to its original position by the force of the return spring 39. At the same time, the supporting frame 47 is moved forward to the position shown in FIGS. 8A and 8B, by the first to third links 48 to 50. In this forward movement of the supporting frame 47, as shown in FIG. 12A, the underside edge 79 of the push-up plate 60 comes into contact with the supporting member 62. However, the supporting member 62 is turned counterclockwise, because the force of the spring 94 exerted in pushing down the push-up plate 60 is greater than the resultant force of the springs 64 and 65. Accordingly, the push-up plate 60 is slid forward on the undersurface of the engaging tongue piece 93 without pushing up the tongue piece 93. The backing paper 5 is fixedly held by the pressing member 86 so that it is not returned forward by the pawl member 46. Thus, the feeding pawl 45 of the pawl member 46 comes out of the slit 78 of the backing paper 5 and, at the same time, it is turned clockwise against the force of the spring 59. The feeding pawl 45 slides forward under the backing paper 5 and it returns to the original position of FIG. 8A, wherein the feeding pawl 45 again comes into engagement with a feeding slit 78 in the backing paper 5.

Figure 13:
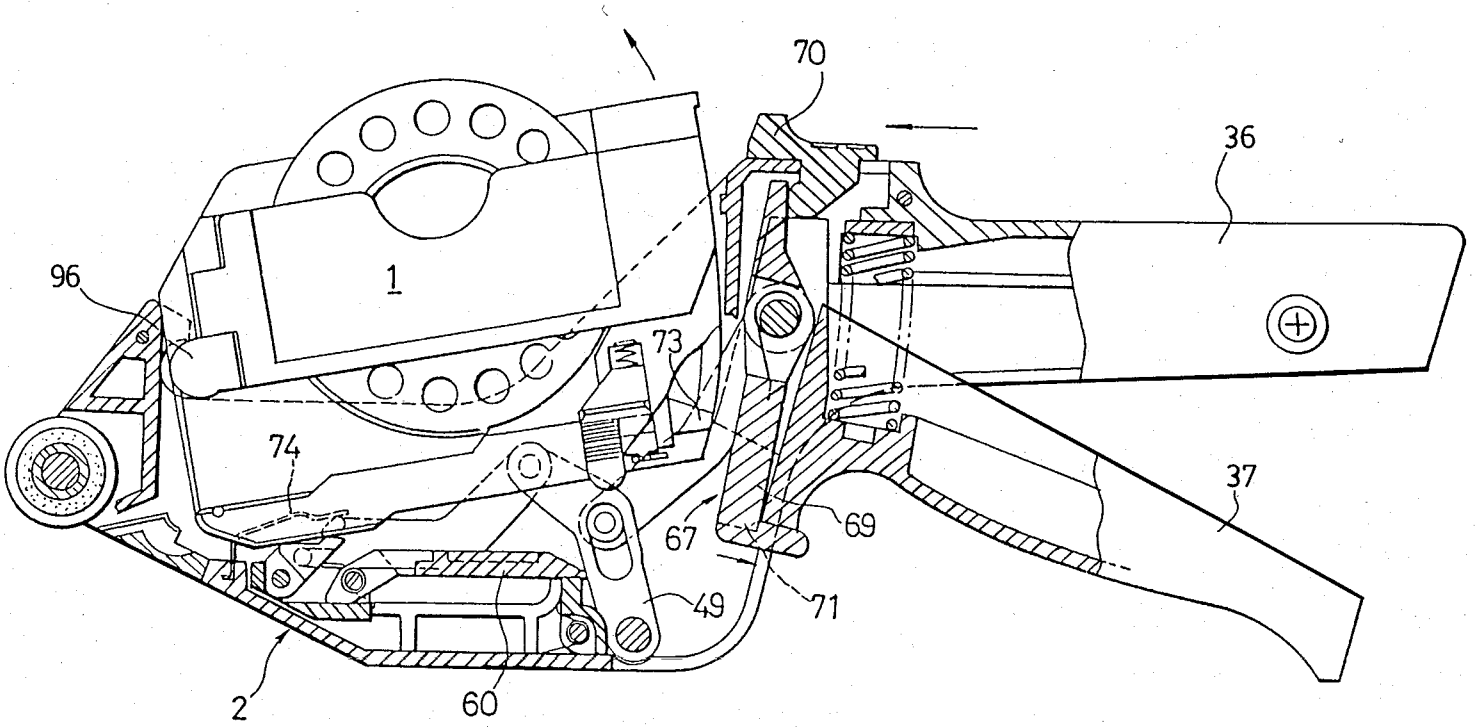
FIG. 13 is a side elevation partially in cross-section of the portable label applying machine of FIG. 4 in which the label cassette is being taken off.

To remove the label cassette 1 from the applying device 2, the release button 70 is pushed forward as shown in FIG. 13. The locking member 69 is turned counterclockwise and the lower edge portion 71 thereof comes off the engaging portion 73 of the label cassette 1. At the same time, the rear side of the label cassette 1 is lifted up to some extent by the spring action of he backing paper pressing plate 74 which pushes up the undersurface of the backing paper 5 in the front portion of the backing paper guide groove 15. Therefore, the label cassette 1 can be detached without difficulty in a single operation.

In the operation of the invention, the backing paper 5 is bent rearwardly, as described above, and the label cassette 1 is attached to the label applying device 2 so as to perform the label applying operation.

In the practical use of the label applying machine according to the present invention, the rolled label strip 3 is attached to the label cassette 1 or a label strip 4 is wound as described above.

However, a plurality of label cassettes 1 having different kinds of rolled label strips 3, are prepared n advance and a suitable label cassette 1 is selected and it is attached to the applying device 2 in each use. In this way, since the label cassettes 1 can be interchanged by a single operation without difficulty, then only one applying device 2 is sufficient. This is quite economical.

The portable label applying machine of the present invention comprises an applying device which detachably holds a label cassette carrying a rolled label strip and peels the printed labels from the backing paper by a manually controlled operation and pays out the peeled labels in such manner that they may be readily applied to surfaces of articles.

When the label applying machine of the present invention having the above-described structure is used, the following advantages are obtained:

(1) As the printing on labels is carried out by means of a separate printing device, the printed images are clear and accurate as compared with the ordinary label printing and applying machines and, when bar codes are used, check digits can be automatically calculated and printed by the printing device.

(2) Since the printing head is not necessary for the label applying machine, the machine can be made small in size and weight, which improves the work efficiency, accelerates label applying work and reduces the fatigue of operators.

(3) As compared with manual applying of labels, the applying speed can be increased without smudging, blurring or soiling the printed surfaces of labels.

(4) Since the replacement of the label cassette carrying a label strip can be performed by a single operation, changing of label strips can be done rapidly and easily.

(5) Only one applying machine is sufficient for various kinds of labels, thereby providing substantial economic advantage.

Although the present invention hs been described in connection with a number of preferred embodiments thereof, many variations and modifications will now become apparent to those skilled in the art. It is preferred, therefore, that the present invention be limited not by the specific disclosure herein, but only by the appended claims.

What is claimed is:

1. A label applying device for applying labels peeled from a web of backing, the web being carried in a cassette, the device comprising:

a frame having a receiving section for receiving a cassette carrying a label web having a backing and a series of labels adhered to the backing; the receiving section defining a feed path for feeding the backing in a feed direction away from a peeling section of the cassette; and a feeding mechanism on the frame for engaging the backing along the feed path and for feeding the backing in the feed direction for peeling the labels in series from the backing at the peeling section of the cassette as the backing is fed.

2. The device of claim 1, further comprising an applying section on the frame for receiving the peeled labels from the peeling section of the cassette and for applying the peeled labels to articles to be labeled.

3. The device of claim 1 in which the receiving section has a recess defined in the frame for holding the cassette, the recess being shaped to generally conform to the shape of the cassette.

4. The device of claim 1 in which the receiving section comprises a guide plate for facing a side of the cassette for defining the feed path between the guide plate and the side of the cassette, the guide plate having an outlet end for defining an outlet of the feed path, the backing exiting from the feed path at the outlet thereof.

5. The device of claim 4, further comprising a cutter on the frame at the outlet end of the guide plate for cutting the backing.

6. The device of claim 4 in which the guide plate extends from near the peeling section of the cassette to the outlet end of the guide plate and has a concavely curved section between the peeling section and the outlet end.

7. The device of claim 6 in which the concavely curved section of the guide plate has an opening defined therein, the feeding mechanism comprising a rotatable feed roller for engaging the backing through the opening.

8. The device of claim 1 in which the feeding mechanism comprises a rotatable feed roller on the frame for engaging the backing along the feed path and a rotating means for rotating the feed roller to feed the backing.

9. The device of claim 8 in which the rotating means comprises a lever means on the frame connected for rotating the feed roller, the feeding mechanism further comprising a one-way clutch connected for permitting rotation of the feed roller only in the direction which feeds the backing in the feed direction.

10. The device of claim 8 in which the rotating means comprises an actuating lever, a rack on the actuating lever, and a pinion connected with the feed roller, the actuating lever being connected with the feed roller through the rack engaging the pinion, for rotating the feed roller when the actuating lever moves.

11. The device of claim 10 in which the rotating means further comprises a manually operable handle connected for moving the actuating lever when an operator moves the handle.

12. The device of claim 1 in which the feeding mechanism comprises a movable feed pawl on the frame for engaging the backing and a moving means for moving the feed pawl for feeding the backing in the feed direction.

13. The device of claim 12 in which the feed pawl is shaped for fitting into a pawl guide formed in a side of the cassette disposed toward the receiving section of the frame, the feed pawl being guided by the pawl guide for movement along the feed path.

14. The device of claim 12 in which the moving means comprises a manually operable handle connected for moving the feed pawl when an operator moves the handle.

15. The device of claim 14 in which the handle is pivotally mounted on the frame, the moving means further comprising a linkage connected for moving the feed pawl when the handle pivots.

16. The device of claim 12 in which the feed pawl is shaped for passing through an opening therefor defined in the backing.

17. A label applying device for applying labels peeled from a web of backing, the web being carried in a cassette, the device comprising:

a frame having a receiving section for receiving a cassette carrying a label web having a backing and a series of labels adhered to the backing; the receiving section receiving a side of the cassette having a guide path for the backing defined therein, the guide path being defined between a peeling section of the cassette and an outlet section of the cassette; and a feeding mechanism on the frame for projecting into the guide path for feeding the backing in a feed direction from the peeling section toward the outlet section for peeling the labels in series from the backing at the peeling section as the backing is fed.

18. The device of claim 17 in which the receiving section has a recess defined in the frame for holding the cassette, the recess being shaped to generally conform to the shape of the cassette.

19. The device of claim 17, further comprising an applying section on the frame for receiving the peeled labels from the peeling section of the cassette and for applying the peeled labels to articles to be labeled.

20. The device of claim 19 in which the feeding mechanism comprises a rotatable feed roller on the frame for engaging the backing in the guide path and a rotating means for rotating the feed roller to feed the backing.

21. The device of claim 20 in which the rotating means comprises a lever means on the frame connected for rotating the feed roller, the feeding mechanism further comprising a one-way clutch connected for permitting rotation of the feed roller only in the direction which feeds the backing in the feed direction.

22. The device of claim 20 in which the rotating means comprises an actuating lever, a rack on the actuating lever, and a pinion connected with the feed roller, the actuating lever being connected with the feed roller through the rack engaging the pinion, for rotating the feed roller when the actuating lever moves.

23. The device of claim 22 in which the rotating means further comprises a manually operable handle connected for moving the actuating lever when an operator moves the handle.

24. The device of claim 19 in whigh the feeding mechanism comprises a movable feed pawl on the frame for engaging the backing in the guide path and a moving means for moving the feed pawl for feeding the backing in the feed direction.

25. The device of claim 24 in which the feed pawl is shaped for fitting into a pawl guide formed in a side of the cassette disposed toward the receiving section of the frame, the feed pawl being guided by the pawl guide for movement along the feed path.

26. The device of claim 24 in which the moving means comprises a manually operable handle connected for moving the feed pawl when an operator moves the handle.

27. The device of claim 26 in which the handle is pivotally mounted on the frame, the moving means further comprising a linkage connected for moving the feed pawl when the handle pivots.

28. The device of claim 24 in which the feed pawl is shaped for passing through an opening therefor defined in the backing.

29. The device of claim 24, further comprising releasing means on the frame for releasing a backing pressing mechanism along the guide path on the cassette when the backing is fed.

30. The device of claim 29 in which the releasing means comprises means attached to the feed pawl and movable therewith for engaging the backing pressing member for moving it to release the backing.

31. The device of claim 19, further comprising releasing means on the frame for releasing a backing pressing mechanism along the guide path on the cassette when the backing is fed.

* * * * *